US006820311B2

(12) United States Patent
Checketts

(10) Patent No.: US 6,820,311 B2
(45) Date of Patent: Nov. 23, 2004

(54) LOCKING APPARATUS

(76) Inventor: Stanley J. Checketts, 900 E. Canyon Rd., Providence, UT (US) 84332

( * ) Notice: Subject to any disclaimer, the term of this patent is extended or adjusted under 35 U.S.C. 154(b) by 0 days.

(21) Appl. No.: 09/922,588

(22) Filed: Aug. 3, 2001

(65) Prior Publication Data

US 2003/0025336 A1 Feb. 6, 2003

(51) Int. Cl.[7] ..... A44B 11/25
(52) U.S. Cl. ..... 24/634; 24/629; 24/633
(58) Field of Search ..... 24/DIG. 43, DIG. 47, 24/DIG. 48, DIG. 51, DIG. 53, DIG. 60, 602, 603, 629, 644, 647, 648–650; 297/468, 469, 460; 280/801.1, 802; 70/142, 150, 181

(56) References Cited

U.S. PATENT DOCUMENTS 1,797,829 A * 3/1931 Hultgren ..... 297/369
2,244,650 A * 6/1941 Curran et al. ..... 297/487
2,819,733 A * 1/1958 Maisch ..... 285/317
4,545,618 A * 10/1985 Kitamura ..... 297/410
5,628,096 A * 5/1997 Watters et al. ..... 24/580
5,865,559 A * 2/1999 Yang ..... 403/322.1
6,428,049 B1 * 8/2002 Nichols

* cited by examiner

*Primary Examiner*—Robert J. Sandy
*Assistant Examiner*—Ruth C. Rodriguez
(74) *Attorney, Agent, or Firm*—Fehr Law Firm; Thompson E. Fehr

(57) ABSTRACT

A locking mechanism having a serrated rod that fits into an aperture of a rotatably mounted block when biasing which pushes the block toward the direction of insertion is reduced. Pulling the serrated rod, after insertion, in the direction from which insertion occurred tends to increase biasing and, consequently, decrease diameter of the aperture projected perpendicular to the length of the serrated rod thereby retaining the serrated rod within the aperture. An end of the serrated rod that does not have the serrations can be formed into a loop for attaching a belt or have screw thread for connection to a bar. The belt or bar would restrain a person or physical object.

17 Claims, 6 Drawing Sheets

LOCKING APPARATUS

BACKGROUND OF THE INVENTION

1. Field of the Invention

This invention relates to an apparatus for releasably holding a physical object including, but not necessarily limited to, a participant on an amusement ride.

2. Description of the Related Art

The inventor is unaware of any locking apparatus that involves insertion of a serrated rod into an aperture of a directionally biased block.

Traditional tabs for attachment to the clot of a seat belt are, however, well known. The tab generally contains an aperture. When the tab is inserted into a female connector, the tab pushes a spring-biased projection aside until the aperture is aligned with the projection so that the projection is forced into the aperture thereby preventing withdrawal of the tab until the projection is pushed or otherwise withdrawn from the aperture.

Additionally, a movable bar may be placed across the lap or shoulders of a participant on an amusement ride. After the bar has been placed in the position for holding the participant, it is generally hydraulically maintained in that position.

SUMMARY OF THE INVENTION

The Locking Apparatus of the present invention utilizes a rod wherein the diameter of the rod varies periodical as one moves along the rod from a first end. It also includes a block having an aperture. The maximum thickness of the rod is less than the minimum diameter of the aperture in the block so that the rod can be inserted into the aperture.

Between the center of the aperture and a first end of the block, the block is rotatably attached to a support structure, and the second end of the block is biased toward the direction from which the rod is intended to be inserted. The biasing of the block reduces the minimum diameter of the aperture as projected perpendicular to the longitudinal axis of the rod. The projected minimum diameter of the aperture is then less than the periodic maximum diameter of the rod so that pushing the rod into the aperture tends to decrease the biasing, thereby increasing the minimum projected diameter of the aperture, until the minimum projected diameter of the aperture exceeds the periodic maximum diameter of the rod so that the rod can enter the aperture. Continuing to push the rod enables it to proceed farther into the aperture. As the rod is pushed farther into the aperture, however, the biasing pushes the edge of the aperture into a portion of the rod between periodic maximum diameters. Then attempting to withdraw the rod causes the rod to pull the block and thereby either maintain or increase the biasing, which consequently reduces the projected diameter of the aperture and precludes withdrawal of the rod.

When it is desired to release the rod, any means well known in the art for applying a physical force is used to push against or pull the block to reduce the biasing.

The second end of the rod is available for connection to a restraining device such as the cloth of a seat belt or a bar.

Since the rod can be pushed farther into the block, the block and rod, themselves, provide adjustability and do not require varying the length of a fabric belt, as does a traditional seat belt in order to achieve adjustability.

Preferably, but not necessarily, a sensor detects whether the rod has been inserted into the aperture.

DESCRIPTION OF THE PREFERRED EMBODIMENT

Figure 1:
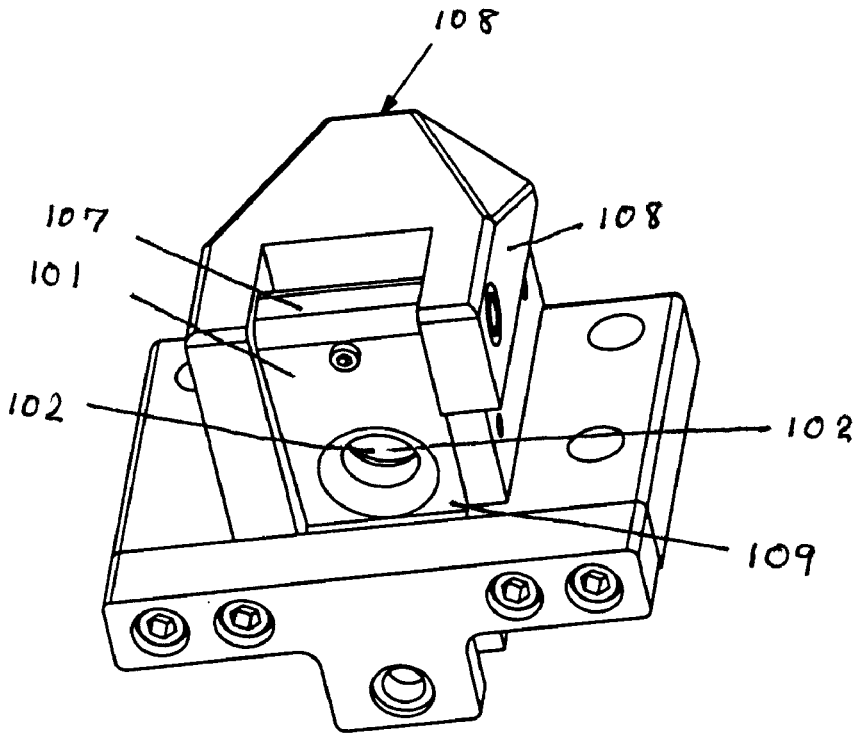
FIG. 1 provides a normal view of the Locking Apparatus.
Figure 2:
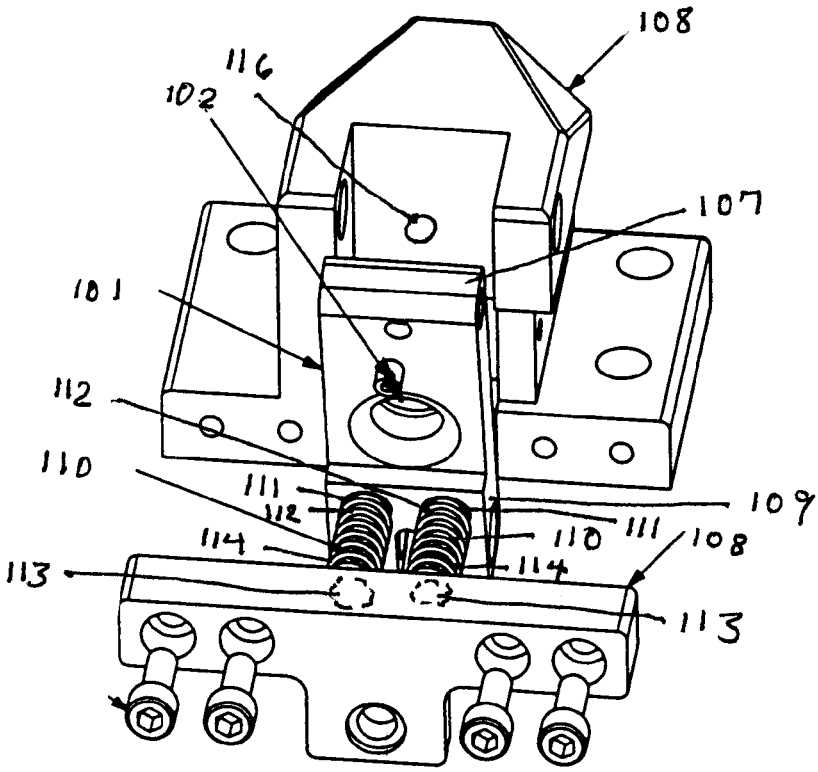
FIG. 2 is an exploded view of the Locking Apparatus.
Figure 3:
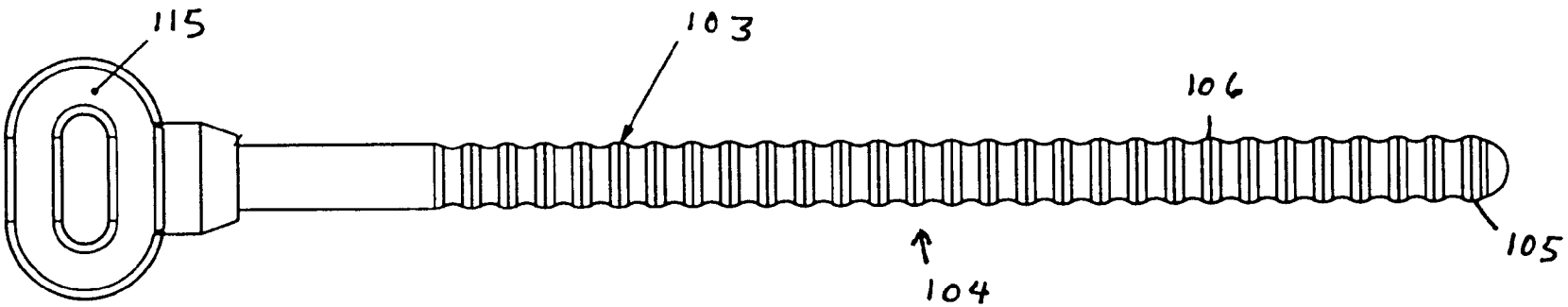
FIG. 3 shows a rod having its second end in the shape of a loop.
Figure 4:
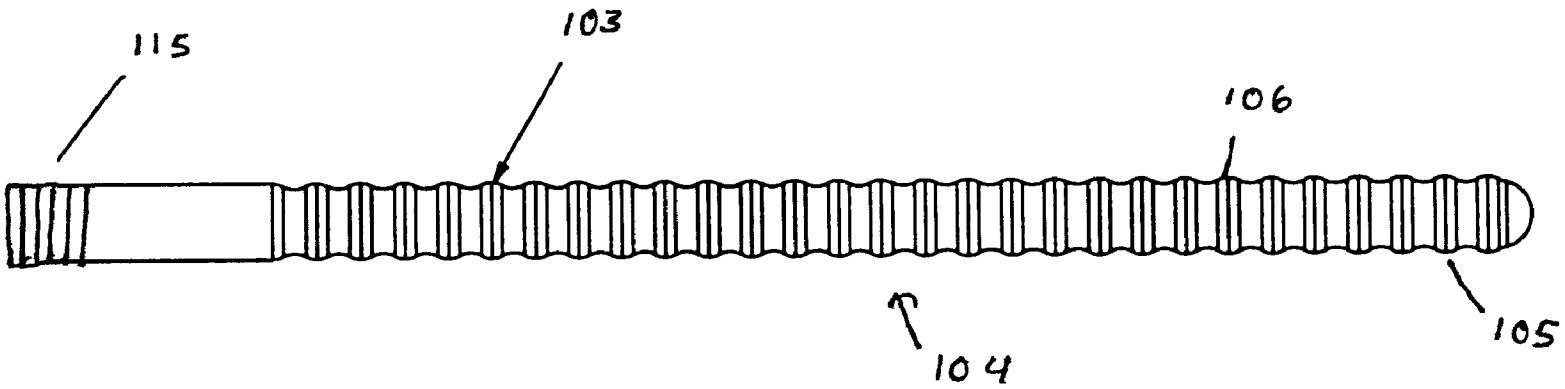
FIG. 4 illustrates a rod having screw threads on its second end.

The Locking Apparatus has a block 101 containing an aperture 102.

A rod 103 is removably insertable into the aperture 102. The rod 103 is serrated, i.e., the thickness of the rod 103 varies periodically along a portion 104 of the length of the rod 103 beginning near a first end 105 of the rod 103.

The maximum periodic thickness 106 of the rod 103 is less than the minimum diameter of the aperture 102 in the block 101 so that the rod 101 can be inserted into the aperture 102.

Between the center of the aperture 102 and a first end 107 of the block 101, the block is rotatably attached to a support structure 108. The block 101 is biased so that the second end 109 of the block 101 is farther toward the direction from which the rod 103 is intended to be inserted that is the first end 107 of the block 101. Preferably, but not necessarily, such biasing is done between the center of the aperture 102 and a second end 109 of the block 101.

Biasing may be accomplished by any device 110, such as a spring that will exert a physical force between the block 101 and the support structure 108. Preferably, but not necessarily, the block 101 contains a first depression 111 to hold a first end 112 of the device 110; and preferably, but not necessarily, the support structure 108 contains a second depression 113 to hold a second end 114 of the device 110.

The second end 115 of the rod 103 is available for connection to a restraining device such as the cloth of a seat belt or a bar and is shaped to accommodate such restraining device. This shape is generally a loop for a seat belt or screw threads for insertion into a bar.

Operation of the Locking Mechanism was discussed above. From that discussion it will be apparent that the further the rod 103 is pushed into the block 101, the tighter the restraint will be. Furthermore, that description will be repeated here with reference to drawings for added clarity.

Figure 5:
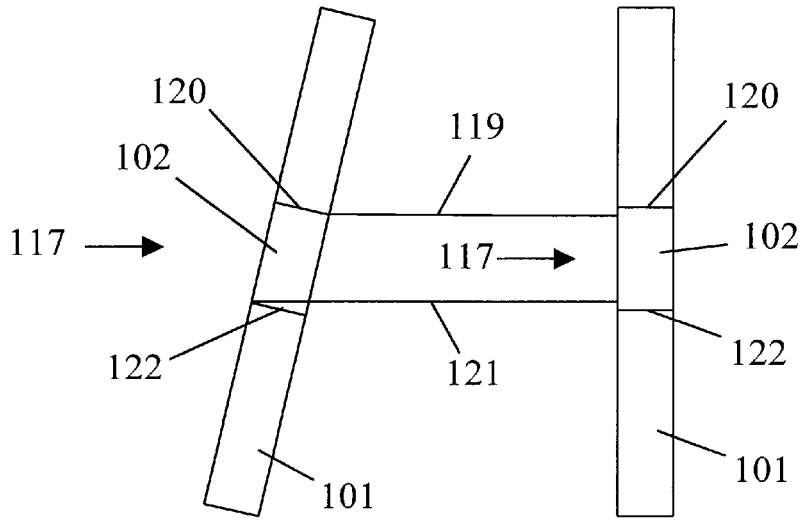
FIG. 5 is a cutaway drawing showing how the diameter of the aperture in the block of the Locking Apparatus projected perpendicular to the intended path of insertion for the rod decreases as the block is biased away from being perpendicular to such intended path.
Figure 8:
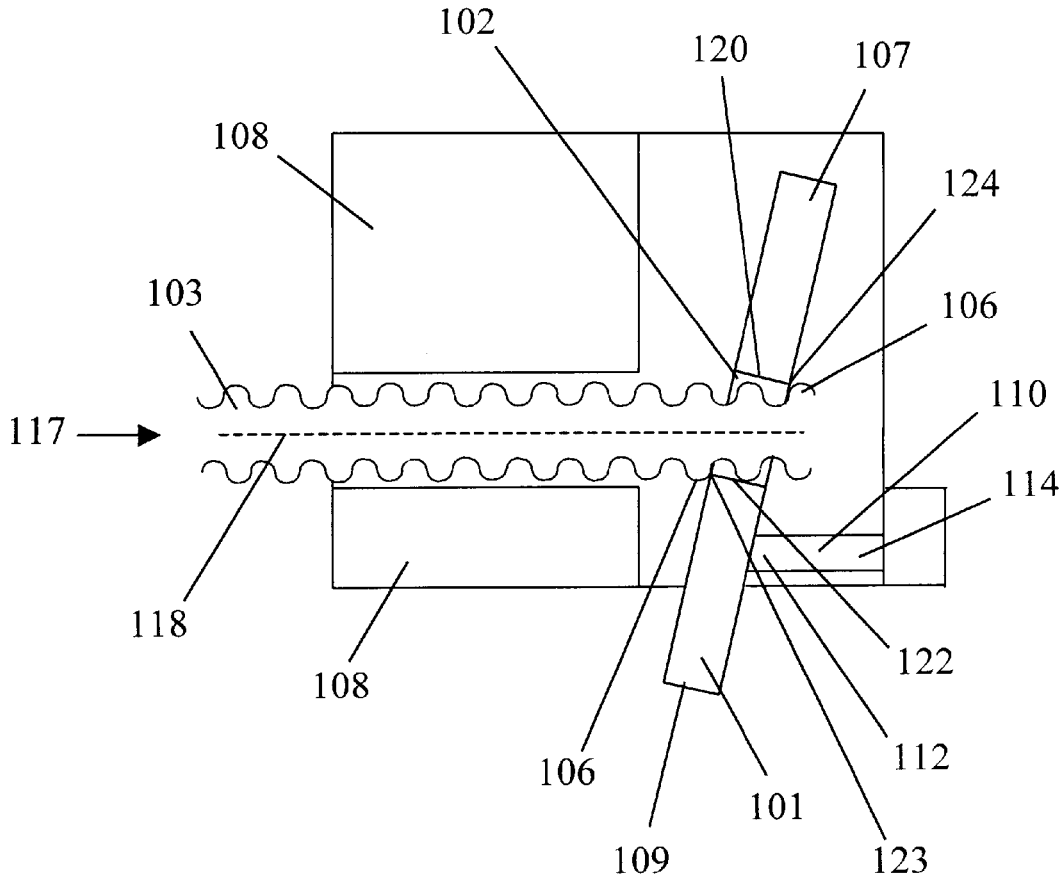
FIG. 8 is a cutaway drawing showing how the aperture in the support structure facilitates maintaining the rod along the intended path of insertion and withdrawl.

The biasing of the block 101 reduces the diameter of the aperture 102 in the block 101 as projected perpendicular to the intended path of introduction and withdrawal 117 of the rod 103, which is also perpendicular to the longitudinal axis 118 of the rod 103, as can be seen in FIG. 5 and FIG. 8.

In FIG. 5, the biased block 101 is shown on the left; for comparison, an unbiased block 101 is pictured on the right. Line 119 projects the top 120 of the biased aperture 102 to the unbiased block 101, which is perpendicular to the intended path of insertion 117 of the rod 103; and line 121 projects the bottom 122 of the biased aperture 102 to the unbiased block 101.

It is evident the projected diameter of the aperture 102 decreases as the block 101 is biased more. At a given point the projected diameter of the aperture 102 will be less than the periodic maximum thickness 106 of the rod 103, as portrayed in FIG. 6. Of course, elementary physics will enable one to understand that the closer the periodic maximum thickness 106 of the rod 103 is to the diameter of the aperture 102 in the block 101, the less biasing will be necessary for the projected diameter of the aperture 102 to become less than the periodic maximum thickness 106 of the rod 103.

Figure 6:
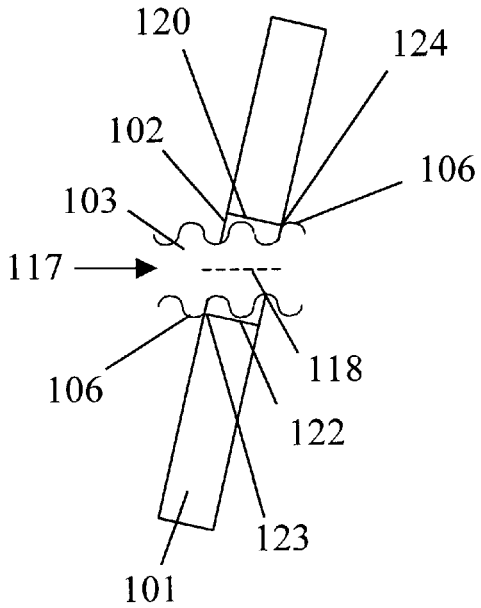
FIG. 6 is a cutaway drawing demonstrating both how any one of the maximum periodic diameters of the rod will, if attempted to be withdrawn, be blocked by an inner edge of the aperture in the block and how, if the rod is attempted to be inserted farther into the block, one of the maximum periodic diameters of the rod will push against an outer edge of the aperture in the block to reduce biasing of the block and permit further introduction of the rod.
Figure 7:
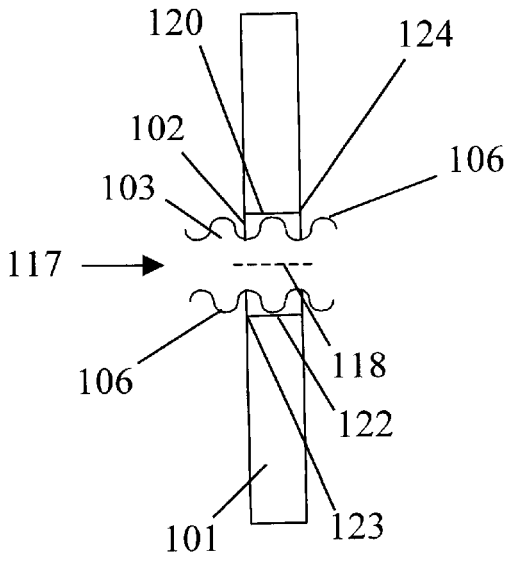
FIG. 7 is a cutaway drawing portraying the block with the biasing removed and, therefore, having the largest possible projected diameter of the aperture in the block perpendicular to the intended path of the rod, which permits the withdrawal of the rod.

From FIG. 6, it is evident that when the block 101 is biased, one of the points of periodic maximum thickness 106 of the rod 103 will push against the outside edge 123 of the bottom 122 of the biased aperture 102 as the rod 103 is attempted to be inserted farther into the aperture 102. This will occur until the biasing is reduced to the extent that the projected diameter of the aperture 102 becomes greater than the periodic maximum thickness 106 of the rod 103, at which point the rod 103 will, as illustrated in FIG. 7, slide farther into the aperture 102 of the block 101.

Since pulling the block opposite to the intended path of insertion 117 of the rod 103 increases the biasing of the block 101, this will tend to decrease the projected diameter of the aperture 102 even more. Thus, as shown in FIG. 6, if the rod 103 is attempted to be withdrawn, i.e., pulled in the direction opposite to the intended path of insertion 117, one of the points of periodic maximum thickness 106 of the rod 103 pull against the inside edge 124 of the top 120 of the biased aperture 102, precluding the withdrawal of the rod 103.

Withdrawal of the rod in the direction opposite to the intended path of insertion 117 is possible only when the biasing of the block 101 is reduced sufficiently that the projected diameter of the aperture 102 becomes greater than the periodic maximum thickness 106 of the rod 103.

Although the function of the Locking Apparatus in precluding withdrawal of the rod 103 in the direction opposite to the intended path of insertion 117 is achieved without any guide to maintain the rod 103 along the intended path of insertion 117, the aperture 125 in the support structure 108 is preferably employed to function as such a guide.

And, as also considered above, any means well known in the art for applying a physical force is used to push against or pull the block 101 to reduce the biasing. Such a means may, e.g., be a manually operated rod or lever, a cable attached to the block 101 to pull the block 101, a motor, a hydraulically powered rod to push the block 101, or a pneumatically powered rod to push the block 101.

Finally, a sensor 116 of any type known in the art for indicating the presence of the rod 103 within the block may be utilized. This could, for example, be a contact sensor or a light sensor.

I claim:

1. A locking apparatus, which comprises:

a support structure;

a block containing an aperture with a center and having a first end and a second end and, between the first end of said block and the center of the aperture, being rotatably attached to said support structure;

a rod having a first end, a second end, and a length, having a portion of said rod beginning near the first end of said rod vary periodically in thickness along the length of said rod with the maximum periodic thickness being less than the minimum diameter of the aperture in said block, and having the second end of said rod available for connection to a restraining device; and a means for biasing said block.

2. The locking apparatus as recited in claim 1, wherein:

the second end of said rod is formed into a loop.

3. The locking apparatus as recited in claim 1, wherein:

the second end of said rod is threaded.

4. The locking apparatus as recited in claim 1, wherein:

said block contains a first depression;

said supporting structure contains a second depression;

and the means for biasing said block is a spring having a first end inserted into the first depression and a second end inserted into the second depression.

5. The locking apparatus as recited in claim 4, wherein:

the second end of said rod is formed into a loop.

6. The locking apparatus as recited in claim 4, wherein:

the second end of said rod is threaded.

7. The locking apparatus as recited in claim 4, further comprising:

a sensor for indicating the presence of said rod within said block.

8. The locking apparatus as recited in claim 7, wherein:

the second end of said rod is formed into a loop.

9. The locking apparatus as recited in claim 7, wherein:

the second end of said rod is threaded.

10. The locking apparatus as recited in claim 7, further comprising:

a means for reducing the biasing.

11. The locking apparatus as recited in claim 10, wherein:

the second end of said rod is formed into a loop.

12. The locking apparatus as recited in claim 10, wherein:

the second end of said rod is threaded.

13. The locking apparatus as recited in claim 4, further comprising:

a means for reducing the biasing.

14. The locking apparatus as recited in claim 13, wherein:

the second end of said rod is formed into a loop.

15. The locking apparatus as recited in claim 13, wherein:

the second end of said rod is threaded.

16. A locking apparatus, which comprises:

a support structure;

a block containing an aperture with a center and having a first end and a second end and, between the first end of said block and the center of the aperture, being rotatably attached to said support structure;

a rod having a first end, a second end, and a length, having a portion of said rod beginning near the first end of said rod vary periodically in thickness along the length of said rod with the maximum periodic thickness being less than the minimum diameter of the aperture in said block, and having the second end of said rod available for connection to a restraining device;

a means for biasing said block; and a means for maintaining said rod on an intended path of insertion.

17. The locking apparatus as recited in claim 16, wherein:

the means for maintaining said rod on an intended path of insertion is an aperture in said support structure.

* * * * *